US008240505B1

(12) United States Patent
Chen

(10) Patent No.: US 8,240,505 B1
(45) Date of Patent: Aug. 14, 2012

(54) EASY-OPEN SEALING TYPE FOOD CONTAINER

(76) Inventor: Ya-Chien Chen, Taipei (TW)

( * ) Notice: Subject to any disclaimer, the term of this patent is extended or adjusted under 35 U.S.C. 154(b) by 0 days.

(21) Appl. No.: 13/189,602

(22) Filed: Jul. 25, 2011

(51) Int. Cl.
*B65D 41/18* (2006.01)

(52) U.S. Cl. ..... 220/793; 200/780; 200/791; 200/4.21

(58) Field of Classification Search ..... 220/780, 220/787, 789, 791, 793
See application file for complete search history.

(56) References Cited

U.S. PATENT DOCUMENTS

| | | | | |
|---|---|---|---|---|
| 4,555,043 | A * | 11/1985 | Bernhardt | 220/783 |
| 5,096,084 | A * | 3/1992 | Wells | 220/835 |
| 6,056,138 | A * | 5/2000 | Chen | 220/4.21 |
| 6,883,678 | B2 * | 4/2005 | Chou | 220/793 |
| 7,097,066 | B2 * | 8/2006 | Tucker et al. | 220/780 |

* cited by examiner

*Primary Examiner* — Harry Grosso
(74) *Attorney, Agent, or Firm* — Rosenberg, Klein & Lee

(57) ABSTRACT

A container including a container body and a sealing cover. A peripheral wall of the container body has at least one recessed wall portion disposed in one corner thereof and forms a retracted external space area and concave camber between the recessed wall portion and a hem. A pull tab extends from an outer side of a cover sealing rib and is inserted into above said concave camber.

4 Claims, 8 Drawing Sheets

EASY-OPEN SEALING TYPE FOOD CONTAINER

BACKGROUND OF THE INVENTION

1. Field of the Invention

The present invention relates to food containers and more particularly, to an easy-open sealing type food container, which provides excellent sealing effects and facilitates opening.

2. Description of the Related Art

Plastic containers of box, cup and bowel types made by means of vacuum molding are suitable for keeping food fresh.

For keeping jelly, pudding, cheese or other liquid food, the food container must be well sealed, avoiding leakage during delivery or transportation.

FIG. 1 illustrates a food container 1 according to the prior art. According to this design, food container 1 comprises a container body 11 holding a liquid food 12, and a plastic film or aluminum foil 13 sealed to the top open side of the container body 11 to prevent leakage during delivery. This food container 1 is a disposable design, not re-sealable.

FIG. 2 illustrates another design of food container 2 according to the prior art. According to this design, the food container 2 comprises a container body 21, and a cover 22 hinged to the container body 21. The cover 22 has a retaining lug 221 protruded from the periphery for engaging a protrusion 211 at the rim of the container body 21. This design of food container 2 is adapted for keeping solid food 23. When used to hold liquid food, the retaining lug 221 and the protrusion 211 must be heat-sealed. However, it is difficult to open the food container 2 after the retaining lug 221 and the protrusion 211 are heat-sealed. When serving the contained food, the user may have to use a cutter or scissors to destroy the cover 22.

U.S. Pat. No. 6,056,138 discloses a food container, entitled "Triple seal container", as illustrated in FIGS. 3 and 4. According to this design, the food container 3 comprises a container body 31 and a lid 32. The lid 32 has a sealing edge 321 matting corresponding edge 311 of the container body 31, and a locking lip 322 protruding from the sealing edge 321 lockable to the edge 311 of the container body 31. This design of food container eliminates the problem of the food container shown in FIG. 2, however it still has drawbacks as follows:

1. The locking lip 322 is hooked on the bottom side of the edge 311 of the container body 31. When opening the lid 32, the user must pull the locking lip 322 away from the edge 311 of the container body 31 with the fingers. When pulling the locking lip 322 from the edge 311 of the container body 31, the user's fingers may be injured by the locking lip 322 or the edge 311 of the container body 31 accidentally.

2. The locking lip 322 enhances stability of the connection between the lid 32 and the container body 31 to avoid falling of the lid 32 from the container body 31. However, the abutment surface area 33 between the lid 32 and the container body 31 is a plane contact. Because the lid 32 and the container body 31 are made by vacuum molding, their wall thickness is thin. The tension or strength is insufficient to keep the abutment surface area 33 between the lid 32 and the container body 31 in a tight status. If the container body 31 falls down, a contained fluid 35 will leak out of the food container 3 through the gap 34 in the abutment surface area 33 between the lid 32 and the container body 31.

Besides, Inline Plastics Corp. provides a food container under U.S. Pat. No. 7,118,003, entitled "Tamper-resistant container". Further, Belford Patrick Inc. provides a food container under U.S. Pat. No. 5,507,406, entitled "Tamperproof/Tamper evident container". Furthermore, Hsin-Hung Chou discloses a food container under U.S. Pat. No. 6,883,678, entitled "Food container sealing structure".

The aforesaid prior art designs enable a container body to be well sealed by a lid to prevent leakage. The "Food container sealing structure" was invented by the present inventor. According to this design, the container body has a peripheral coupling flange, and the cover has a peripheral coupling flange coupled to the coupling flange of the container body to seal the container body. The coupling flange of the container body has endless concave portions respectively formed in horizontal section and vertical section thereof. The coupling flange of the cover having endless convex portions respectively formed in horizontal section and vertical section thereof and respectively engaged into the endless concave portions of the container body. This design achieves excellent sealing effects. However, due to tight sealing, it is difficult to open the cover from the container body.

Therefore, it is desirable to provide a food container, which achieves excellent sealing effects and facilitates opening.

SUMMARY OF THE INVENTION

The present invention has been accomplished under the circumstances in view. It is a primary object of the present invention to provide an easy-open sealing type food container, which enables the user to open the sealing cover from the container body with the fingers conveniently with less effort without tools.

In order to achieve the object of the present invention, an easy-open sealing type food container includes the following features. A peripheral wall of a container body has at least one recessed wall portion disposed in one corner thereof and defining a retracted external space area between the recessed wall portion and the hem. A recessed third sealing rib extended from the first sealing rib. A lip disposed at an outer side relative to the recessed third sealing rib and a concave camber formed between the lip and the hem; and the sealing cover comprises a fourth sealing rib extended from the second sealing rib for abutment against the third sealing rib of the sealing cover and a pull tab extended from an outer side of the fourth sealing rib and inserting into above said concave camber.

Therefore, the retracted external space area provides a space for the user to hold the easy-open sealing type food container by the fingers of one hand and fingers of another hand holding the pull tab in the concave camber in order to easily open the sealing cover from the container body.

Based on the technical features disclosed, the sealing cover seals the container body tightly and provides a human friendly operating interface for enabling the user to open the food container conveniently with less effort.

DETAILED DESCRIPTION OF THE PREFERRED EMBODIMENT

Figure 1:
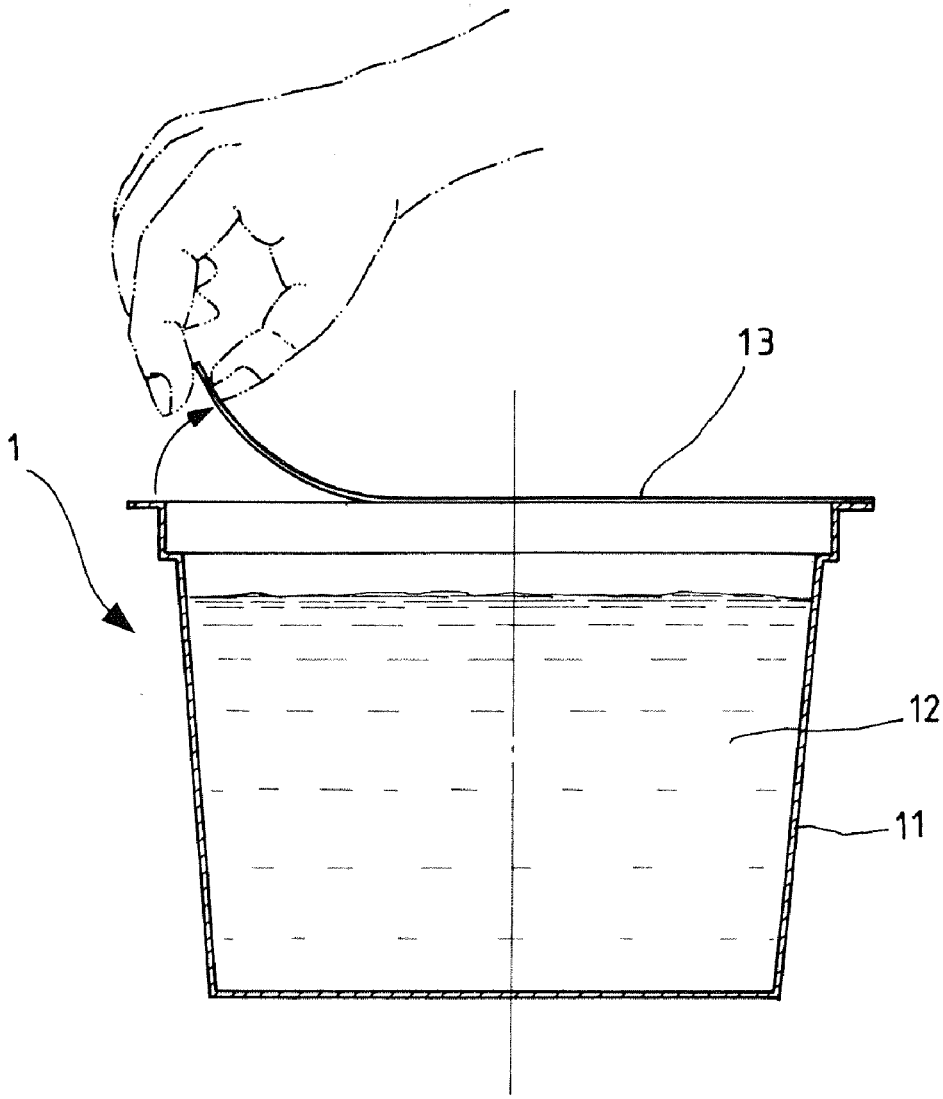
FIG.1 PRIOR ART
FIG. 1 is a schematic drawing of a food container according to the prior art.
Figure 2:
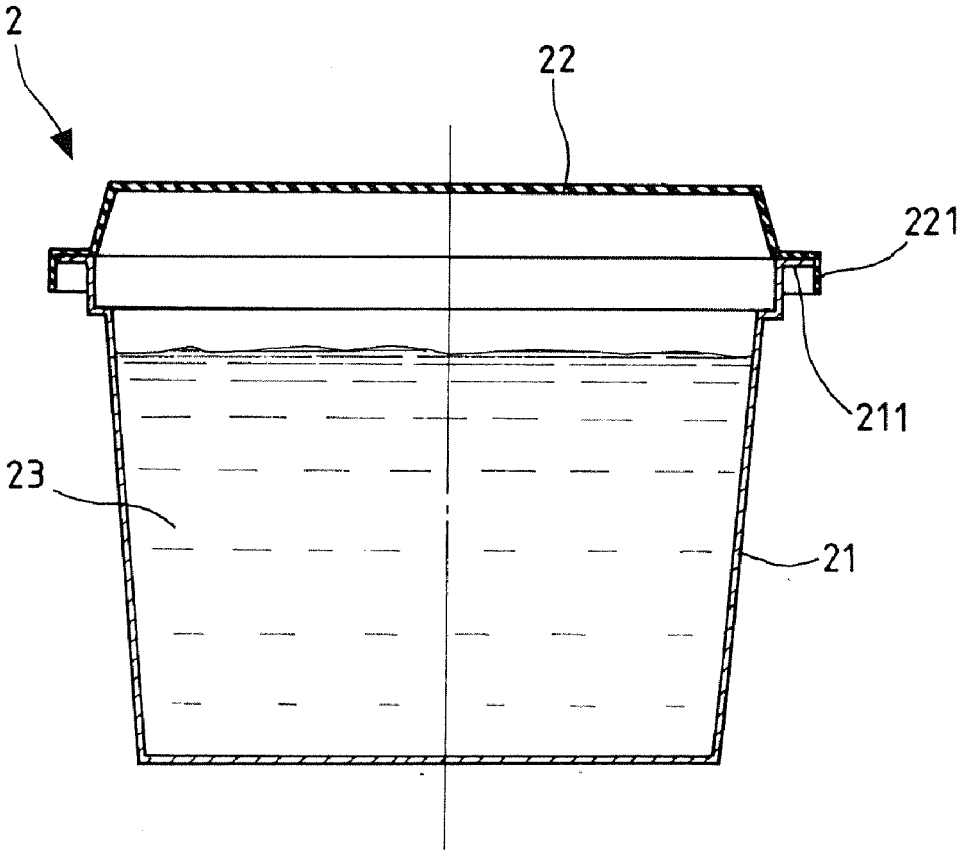
FIG.2 PRIOR ART
FIG. 2 is a schematic drawing illustrating another design of food container according to the prior art.
Figure 3:
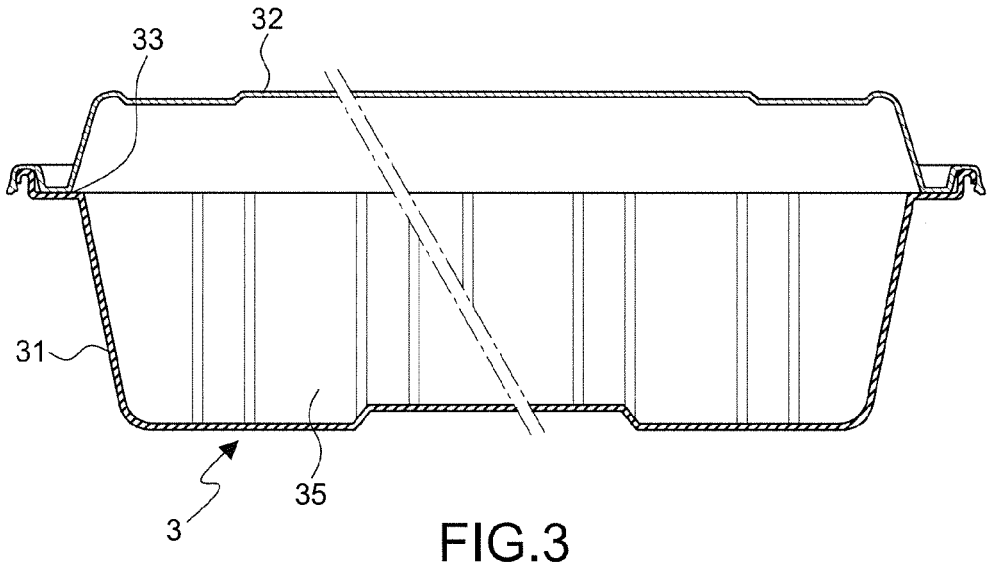
FIG.3 PRIOR ART
FIG. 3 is a schematic drawing illustrating a food container according to U.S. Pat. No. 6,056,138.
Figure 4:
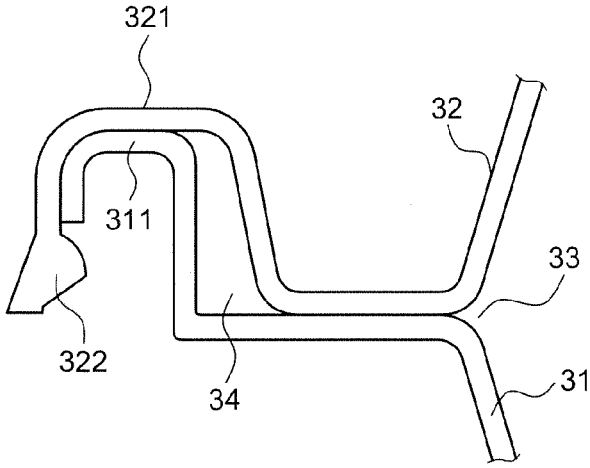
FIG.4 PRIOR ART
FIG. 4 is an enlarged view of a part of FIG. 3.
Figure 5:
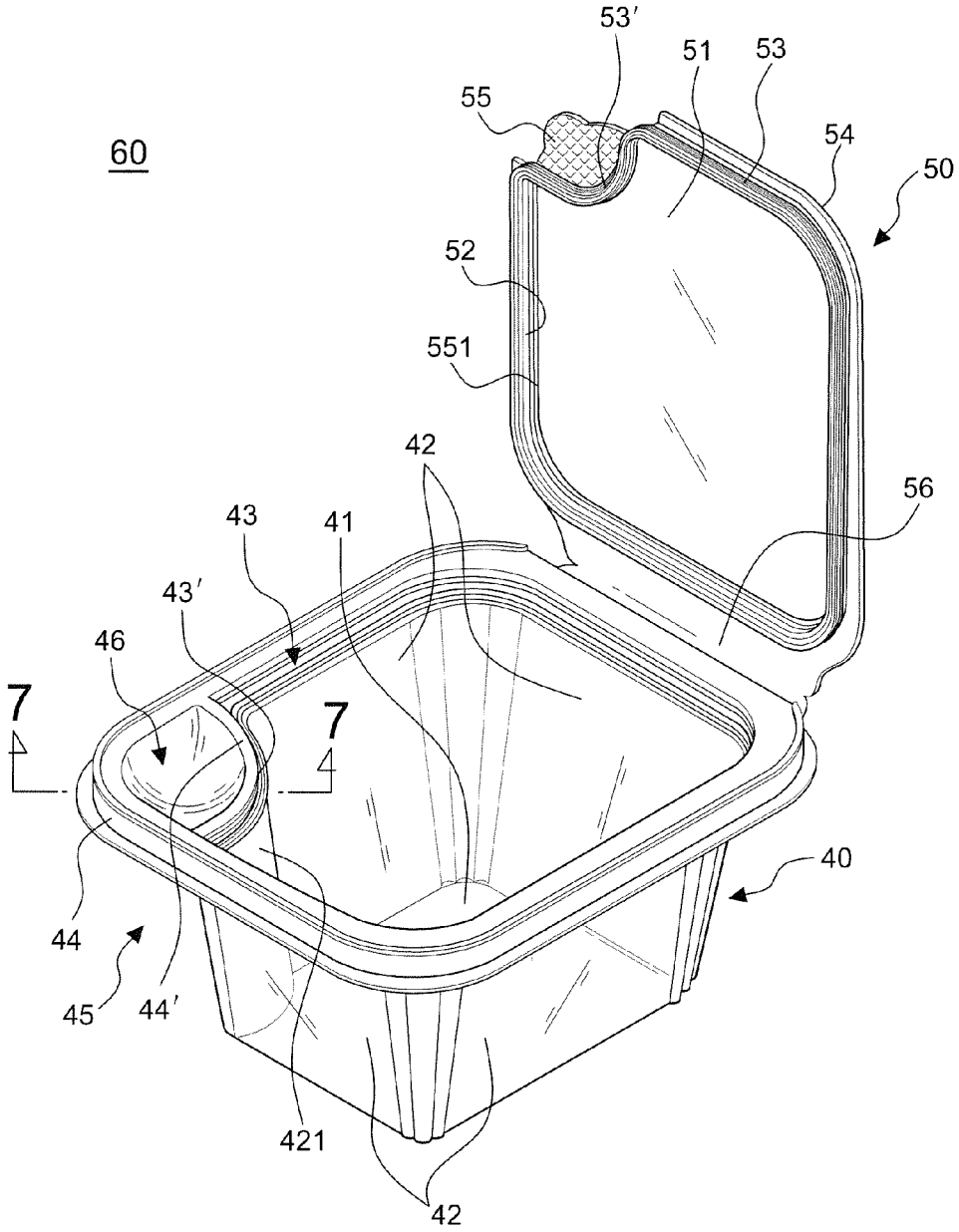
FIG. 5 is an oblique opened view of an easy-open sealing type food container in accordance with the present invention.

Referring to FIGS. 5 to 11, an easy-open sealing type food container 60 on accordance with the invention includes a container body 40 comprising a bottom wall 41, a peripheral wall 42 upwardly extended from the border of the bottom wall 41, and a first sealing rib 43 extending along the border of a top edge of the peripheral wall 42. The first sealing rib 43 comprises a first vertical sealing face 43*b* upwardly extended from a first horizontal sealing face 43*a* and a hem 44 outwardly extended from the first vertical sealing face 43*b*.

Figure 9:
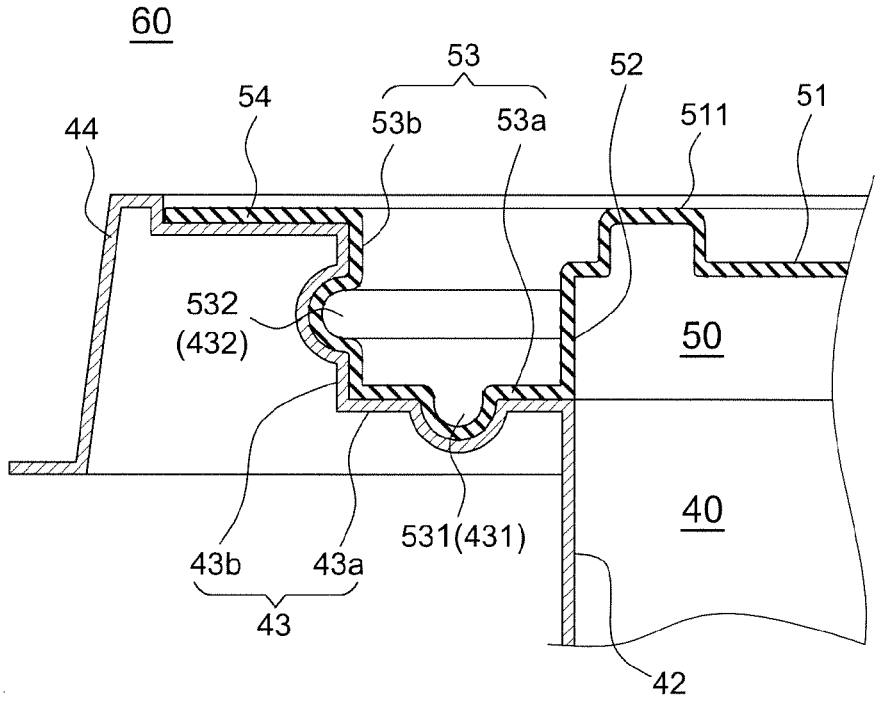
FIG. 9 is a sectional view taken along line 9-9 of FIG. 7.
Figure 10:
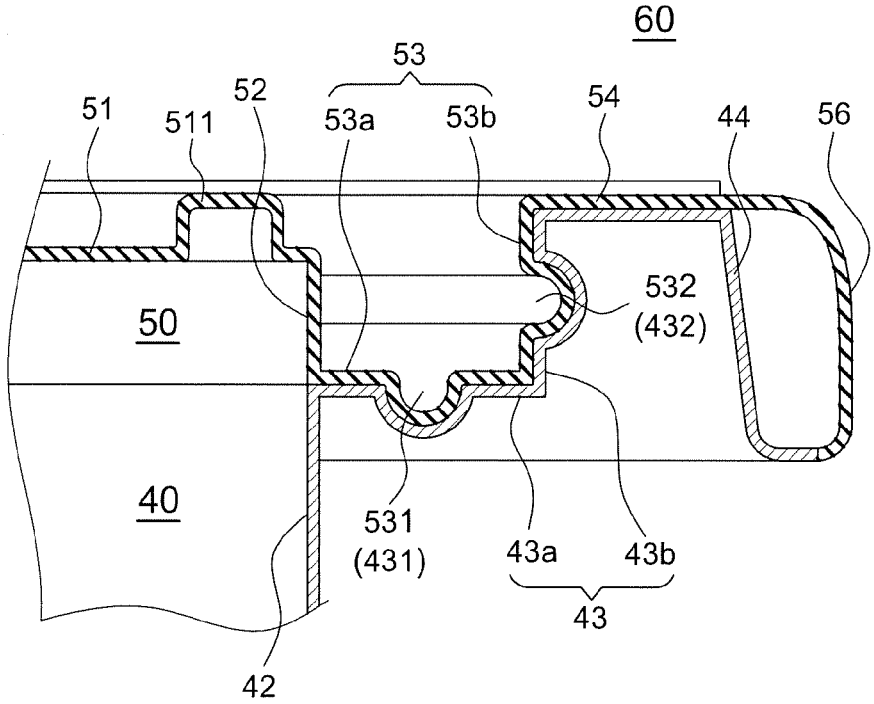
FIG. 10 is a sectional view taken, in an enlarged scale, along line 10-10 of FIG. 5.

With reference to FIGS. 9 and 10, a sealing cover 50 comprises a top wall 51 and a rim 52 downwardly extended from the top wall 51 along the border of the top wall 51 and a second sealing rib 53 extending around the rim 52 to fit the first sealing rib 43. The second sealing rib 53 comprises a second horizontal sealing face 53*a* for abutting against the first horizontal sealing face 43*a*, a second vertical sealing face 53*b* for abutting against the first vertical sealing face 43*b* and a flange edge 54 outwardly extending from the second vertical sealing face 53*b*.

Figure 7:
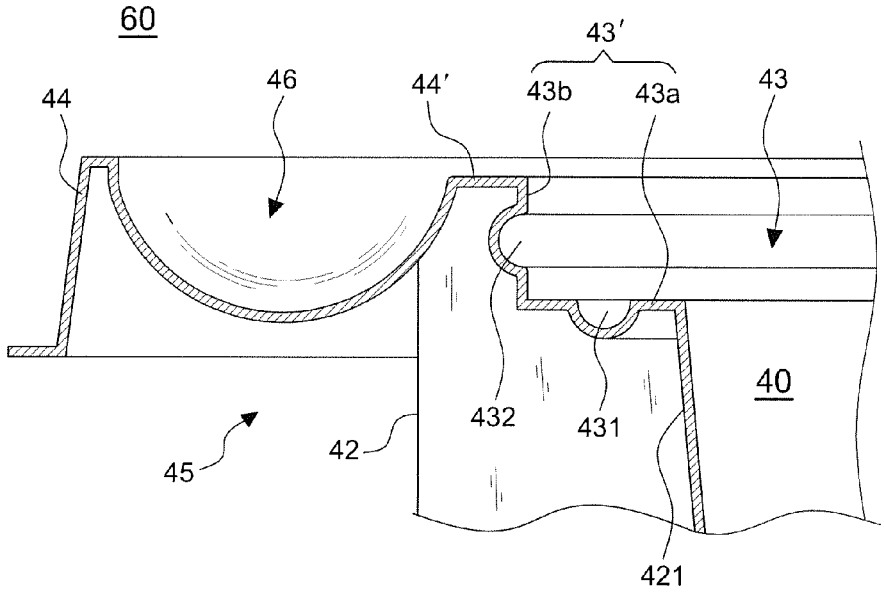
FIG. 7 is a sectional view taken, in an enlarged scale, along line 7-7 of FIG. 5.

From FIGS. 7 to 10, the peripheral wall 42 of the container body 40 has at least one recessed wall portion 421 disposed in one corner thereof and defined a retracted external space area 45 between the recessed wall portion 421 and the hem 44. A recessed third sealing rib 43' extended from the first sealing rib 43. A lip 44' as shown in FIG. 7 disposed at an outer side relative to the recessed third sealing rib 43' and a concave camber 46 formed between the lip 44' and the hem 44. The sealing cover 50 comprises a fourth sealing rib extended 53' from the second sealing rib 53 for abutment against the third sealing rib 43' of the sealing cover 50 and a pull tab 55 extended from an outer side of the fourth sealing rib 53' and inserting into above said concave camber 46.

Figure 8:
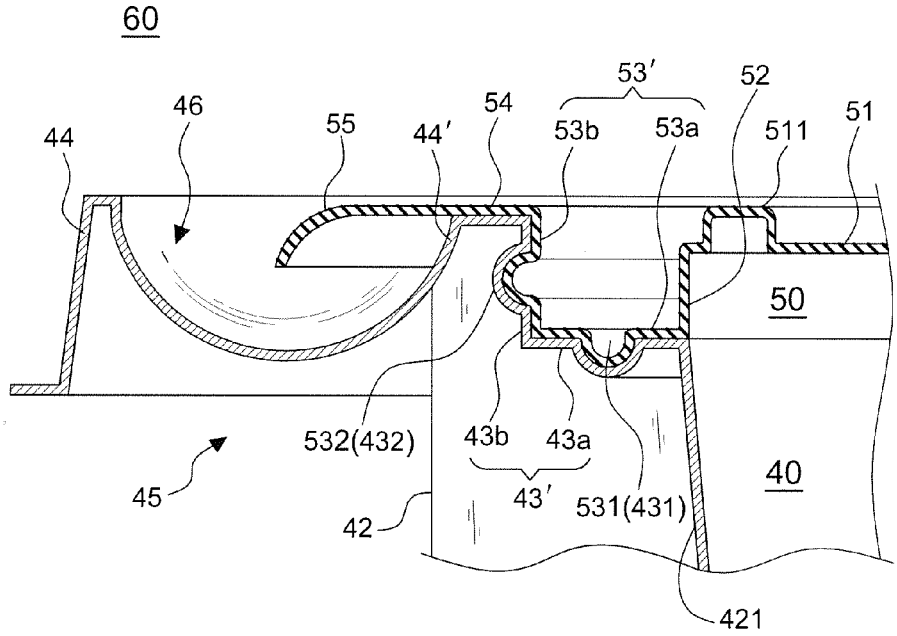
FIG. 8 is a sectional view taken, in an enlarged scale, along line 8-8 of FIG. 6.

Referring to FIGS. 7 and 8, the easy-open sealing type food container 60 in accordance with the present invention is shown comprising the container body 40 defining the retracted external space area 45 and the concave camber 46 at the top side of the retracted external space area 45. Thus, the retracted external space area 45 and the concave camber 46 constitute an operating space convenient for the operation of the both hands to open the food container.

Figure 11:
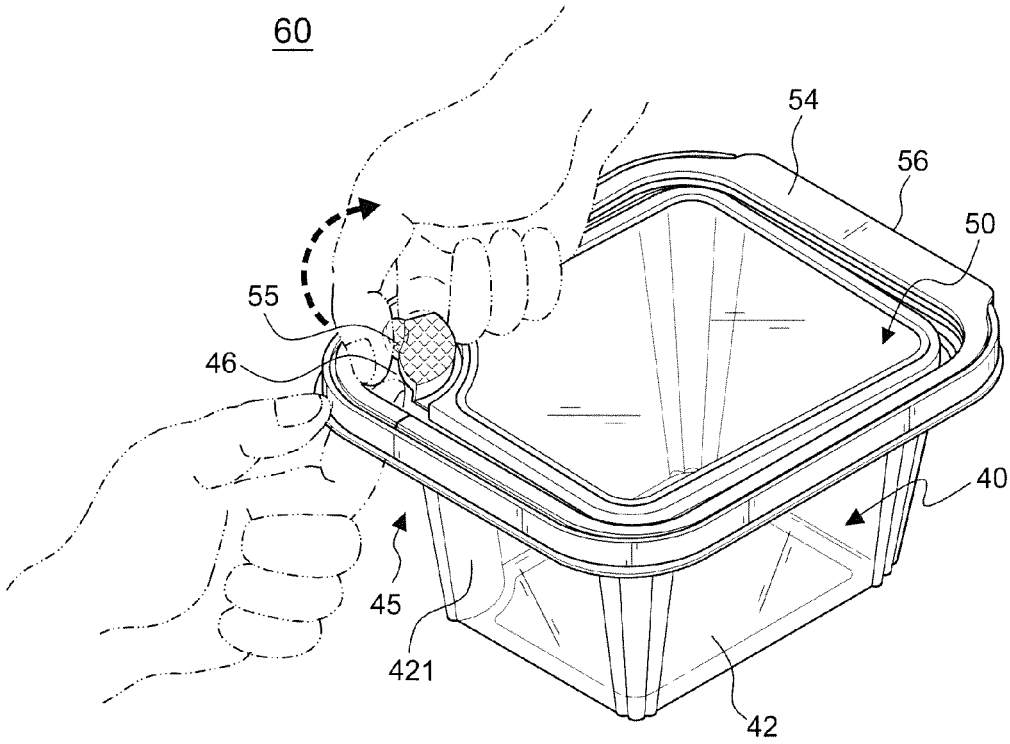
FIG. 11 is a schematic drawing of the present invention, illustrating a status of use of the easy-open sealing type food container.

With reference to FIG. 11, when opening the sealing cover 50, the retracted external space area 45 provides a space for the user to hold the easy-open sealing type food container 60 by the fingers of one hand and fingers of another hand holding the pull tab 56 in the concave camber 46 in order to easily open the sealing cover 40 from the container body 50.

In a preferred embodiment, a lip 44' as shown in FIG. 7 disposed at an outer side relative to the recessed third sealing rib 43' and a concave camber 46 formed between the lip 44' and the hem 44.

In this embodiment, the container body 40 further comprises a first sealing groove 431 surrounded by the first sealing rib 43 and the third sealing rib 43', and a second sealing groove 432 extending along the first vertical sealing face 43*b*. Further, the sealing cover 50 comprises a first engagement protrusion 531 extending along the second horizontal sealing face 53*a* and adapted for engaging the first sealing groove 431, and a second engagement protrusion 532 adapted for engaging the second sealing groove 432. Furthermore, a hinge part 56 connected between the container body 40 and the sealing cover 50 is used for lifting the sealing cover 50 from the container body 40.

Figure 6:
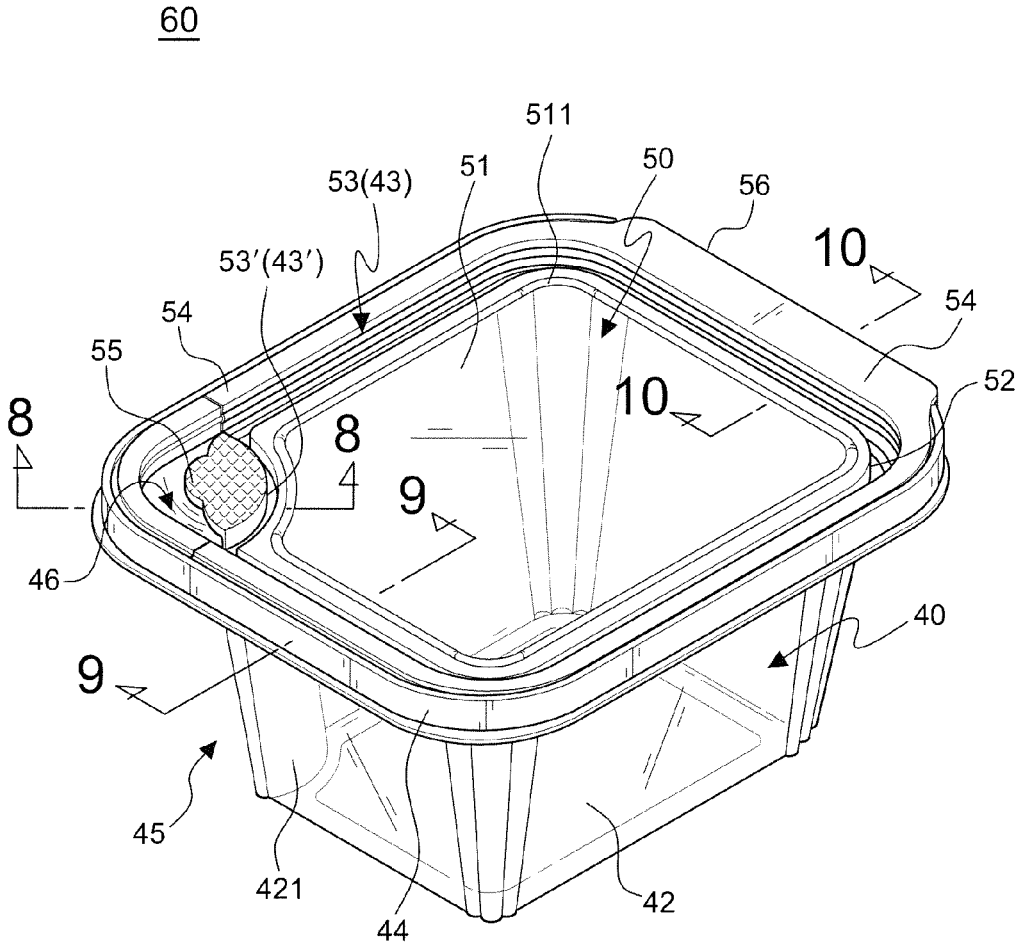
FIG. 6 is a perspective view of the present invention, illustrating the easy-open sealing type food container closed.

With reference to FIG. 6, the sealing cover 50 has an annular rib 511 protruded from the top surface thereof. The annular rib 511 is axially tapered so that a plurality of easy-open sealing type food containers 60 can be stably arranged in a stack by inserting the annular rib 511 of one easy-open sealing type food container 60 into the annular rib 511 of another easy-open sealing type food container 60.

With reference to FIG. 11, a pull tab 55 extends from the periphery of the sealing cover 50 at a location corresponding to the concave camber 46 in a size relatively smaller than the concave camber 46. Thus, the user can insert the fingers into the concave camber 46 beneath the pull tab 55 and then pull the pull tab 55 upwards to disengage the fourth sealing rib 53' at the sealing cover 50 from the third sealing rib 43' at the container body 40, thereby opening the sealing cover 50 from the container body 40 with less effort.

In conclusion, the invention provides an easy-open sealing type food container 60 has an operating space provided around one corner thereof to facilitate the operation of the fingers in lifting the sealing cover 50 from the container body 40 to disengage the fourth sealing rib 53' at the sealing cover 50 from the third sealing rib 43' at the container body 40 with less effort. When the sealing cover 50 is closed on the container body 40, the fourth sealing rib 53' at the sealing cover 50 is sealed with the third sealing rib 43' at the container body 40, keeping the sealing type food container 60 well enclosed, avoiding leakage.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An easy-open sealing type food container, comprising:

a container body comprising a bottom wall, a peripheral wall upwardly extended from the border of said bottom wall, and a first sealing rib extending along the border of a top edge of said peripheral wall, said first sealing rib comprising a first horizontal sealing face, a first vertical sealing face upwardly extended from said first horizontal sealing face and a hem outwardly extended from said first vertical sealing face; and a sealing cover comprising a top wall and a rim downwardly extended from said top wall along the border thereof and a second sealing rib extending around said rim to fit said first sealing rib, said second sealing rib comprising a second horizontal sealing face for abutting against said first horizontal sealing face, a second vertical sealing face for abutting against said first vertical sealing face and a flange edge outwardly extending from said second vertical sealing face;

wherein said peripheral wall of said container body has at least one recessed wall portion disposed in one corner thereof and defining a retracted external space area between said recessed wall portion and said hem, a recessed third sealing rib extended from said first sealing rib, a lip disposed at an outer side relative to said recessed third sealing rib and a concave camber formed between said lip and said hem; and said sealing cover comprises a fourth sealing rib extended from said second sealing rib for abutment against a rim of said third sealing rib of said sealing cover and a pull tab extended from an outer side of said fourth sealing rib and inserting into above said concave camber.

2. The easy-open sealing type food container as claimed in claim 1, wherein said container body further comprises a first sealing groove surrounded by said first sealing rib and said third sealing rib, and a second sealing groove extending along said first vertical sealing face; said sealing cover comprises a first engagement protrusion extending along said second horizontal sealing face and adapted for engaging said first sealing groove, and a second engagement protrusion adapted for engaging said second sealing groove.

3. The easy-open sealing type food container as claimed in claim 1, further comprising a hinge part connected between said sealing cover and a rear part of said container body.

4. The easy-open sealing type food container as claimed in claim 1, wherein said sealing cover further comprises an annular rib protruded from the top wall thereof.

* * * * *